United States Patent [19]

Takenaka et al.

[11] Patent Number: 4,478,589

[45] Date of Patent: Oct. 23, 1984

[54] METHOD OF SHADOW MASK MANUFACTURE

[75] Inventors: Shigeo Takenaka; Eiji Kamohara, both of Fukaya, Japan

[73] Assignee: Tokyo Shibaura Denki Kabushiki Kaisha, Kanagawa, Japan

[21] Appl. No.: 409,355

[22] Filed: Aug. 19, 1982

[30] Foreign Application Priority Data

Sep. 2, 1981 [JP] Japan ..... 56-137001

[51] Int. Cl.[3] ..... H01J 29/07; H01J 9/14

[52] U.S. Cl. ..... 445/37; 72/363; 228/191; 445/49

[58] Field of Search ..... 445/37, 47, 49; 72/363; 228/191

[56] References Cited

U.S. PATENT DOCUMENTS

| | | | |
|---|---|---|---|
| 2,971,117 | 2/1961 | Law | 315/13.1 |
| 3,156,976 | 11/1964 | Whiting | 228/191 X |
| 3,191,291 | 6/1965 | Maier | 72/363 X |
| 3,309,493 | 3/1967 | Vitale | 219/79 |
| 3,368,098 | 2/1968 | Demmy | 313/407 |
| 3,398,309 | 8/1968 | Kaplan | 313/402 |
| 3,574,013 | 4/1971 | Frantzen | 313/402 |
| 3,864,797 | 2/1975 | Banks | 445/47 |
| 4,112,563 | 9/1978 | Van Esdonk | 445/37 |

*Primary Examiner*—Kenneth J. Ramsey

*Attorney, Agent, or Firm*—Cushman, Darby and Cushman

[57] ABSTRACT

A method of making a plurality of masks for a mask-focusing color picture tube is described. A plurality of apertured flat masks are aligned and stacked. The stacked flat masks are contacted by magnetic force and welded together. The welded flat masks are pressed into a predetermined curved shape at the same time. Next, the welded portions are cut off to separate each mask.

7 Claims, 3 Drawing Figures

METHOD OF SHADOW MASK MANUFACTURE

BACKGROUND OF THE INVENTION

The present invention provides a method of making a plurality of masks of a color cathode ray tube (CRT), of the type which are opposed to the phosphor screen of a CRT at a small distance therefrom and are separated from each other, each aperture of each mask being arranged coaxially with a corresponding aperture of another mask over the entire area of the masks.

One such CRT having this type of mask structure is the mask-focusing color picture tube. In a mask-focusing color picture tube, different potentials are applied to the masks and an electrostatic lens is formed between the facing masks. The electron beam utility factor is significantly increased compared with a convential shadow mask type color CRT. A mask-focusing color picture tube is described in Japanese Utility Model publication No. 38930/1972, and U.S. Pat. Nos. 2,971,117 and 3,398,309.

Another type of CRT which has the above described mask structure is described in Japanese Patent Publication No. 2698/1980. This color CRT has two masks. One mask acts as a color selection electrode and the other mask acts as a electron shield for preventing the other mask from being bombarded by electron beams and from being deformed by its rising temperature resulting from that bombardment.

In the both types of color CRTs, the corresponding apertures of the masks must be aligned coaxially with the electron beams. However, it is difficult to make or assemble a plurality of masks with such high precision. In a conventional manner, each apertured flat mask is pressed into its desired curved shape independently from the other mask. The masks are made of thin metal plates and have a relatively large area so that they are subject to being deformed during handling in the manufacturing process. The curvature of each mask is inevitably slightly different from that of the other masks at a given position on the masks. Therefore it is difficult to precisely align the corresponding apertures of each mask.

SUMMARY OF THE INVENTION

A primary object of the present invention is to provide a method of making a plurality of masks for a color CRT, which method makes it easy to precisely align the corresponding apertures of each mask.

Another object of the present invention is to provide a method suitable for the mass production of CRT masks.

Therefore the present invention provides a method of making a plurality of masks for a CRT comprising the steps of:

stacking a plurality of flat masks, each flat mask comprising an effective portion having a plurality of apertures therein, a non-effective portion surrounding said effective portion and welding portions located on the periphery of said non-effective portions;

applying a magnetic force to said flat masks holding them in contact with each other;

welding said plurality of flat masks to one another at their respective welding portions;

releasing said welded flat masks from said magnetic force;

simultaneously pressing said welded flat masks into a predetermined desired curvature; and cutting off said welding portions from all of said masks.

There is also provided by this invention a mask arrangement for a CRT produced by the following method steps:

stacking two (2) flat masks, each mask comprising an effective portion having a plurality of apertures, a non-effective portion surrounding said effective portion and welding portions located the periphery of said non-effective portions;

applying a magnetic force to said flat masks to hold them in contact with each other;

welding said flat masks together at their respective welding portions;

releasing said welded flat masks from said magnetic force;

simultaneously pressing said welded flat masks into the predetermined curvature; and cutting off said welding portions from the masks.

BRIEF DESCRIPTION OF THE DRAWINGS

The invention will be described in detail with reference to the accompanying drawings, wherein.

DETAILED DESCRIPTION OF THE PREFERRED EMBODIMENT

Figure 1:
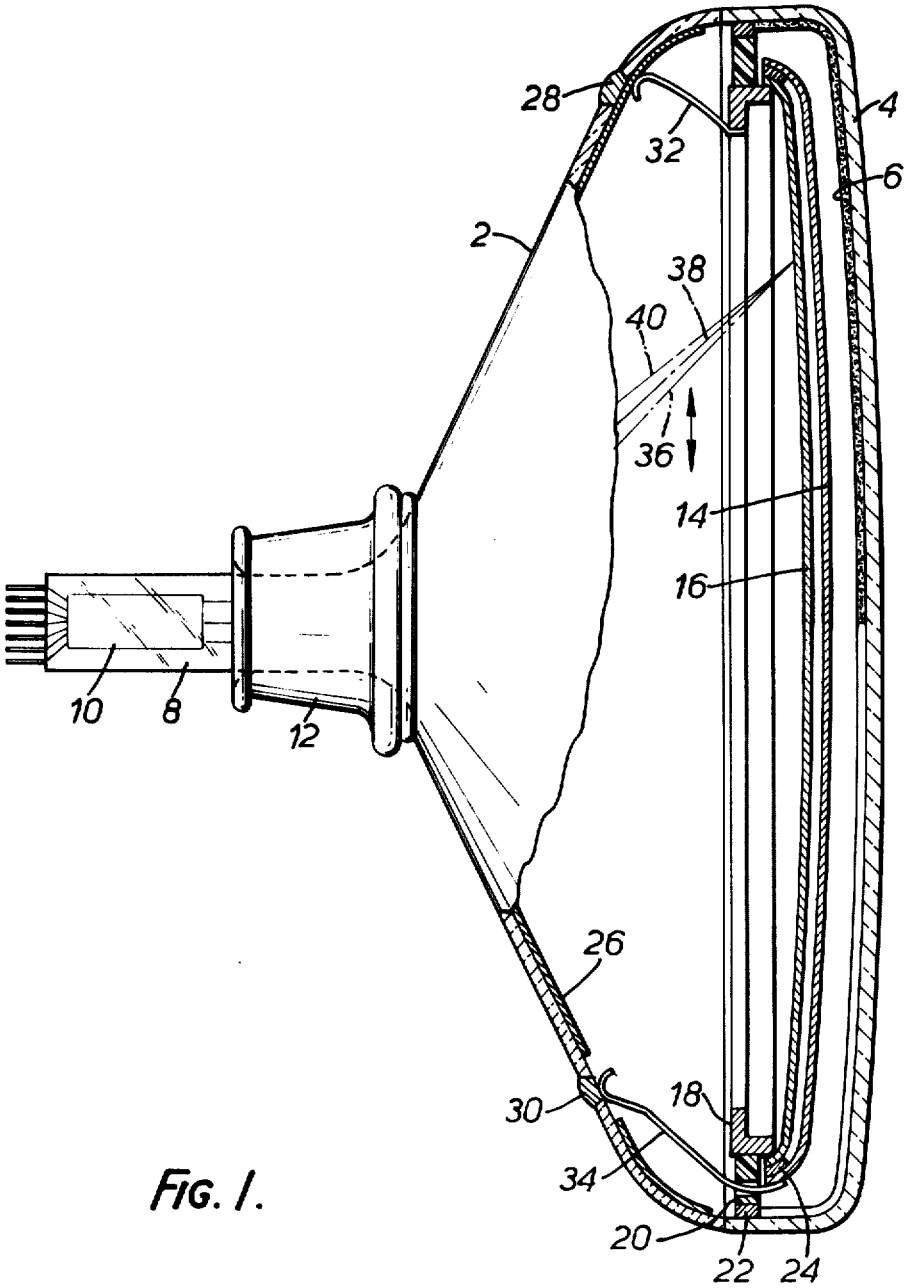
FIG. 1 is a cross-sectional view of a mask-focusing color cathode ray tube made in accordance with the method steps of the present invention.

Referring now to FIG. 1, there is shown a cross-sectional view showing the arrangement of a mask-focusing color picture tube including a mark arrangement having two (2) marks formed according to the present invention. A funnel 2 is joined to the outer periphery of a face plate 4, on the inner surface of which is formed a metal-backed phosphor screen 6. A neck 8 is joined to the end of funnel 2. Electron guns 10 are disposed within neck 8. A deflection apparatus 12 is mounted on the outer surfaces of funnel 2 and around neck 8. A first shadow mask 14 opposes phosphor screen 6, and a second shadow mask 16 opposes first shadow mask 14. First and second shadow masks 14 and 16 each have a plurality of apertures therein. Second shadow mask 16 is mounted to face plate 4 by a mask frame 18, elastic support members 20 and pins 22. First shadow mask 14 is mounted to second shadow mask 16 through an insulating member 24. The metal-backed phosphor screen 6 comprises phosphor stripes of regularly alternating three colors coated on the inner surface of face plate 4, and a thin metal layer formed on the phosphor stripes. A conductive film 26 is uniformly coated on the inner surface of funnel 2 and on a part of the inner surface of neck 8. Two buttons 28 and 30 are mounted on funnel 2 for applying the different voltages from outside. Button 28 is electrically connected to conductive film 26 and an elastic connector 32 connecting to mask frame 18 and the metal-backed phosphor screen layer 6 through pins 22. The other button 30 is electrically connected to first shadow mask 14 through an elastic connector 34. The applied potential of metal-backed phosphor screen 6 and second shadow mask 16 is slightly higher than that of first shadow mask 14.

In the color picture tube arrangement described above, three electron beams 36, 38 and 40 emitted from the electron guns 10, deflected by deflection apparatus 12, are selectively focused by second and first shadow masks 16 and 14, passing through their apertures and impinging on the appropriate phosphor stripes which then emit light of the corresponding colors. Therefore the corresponding apertures of each mask must be arranged coaxially. The fabrication method steps result in the formation of a mask arrangement in which the apertures are more accurately aligned them in mask arrangements fabricated by known techniques and which can be manufactured less expensively than by known techniques described below.

Figure 2:
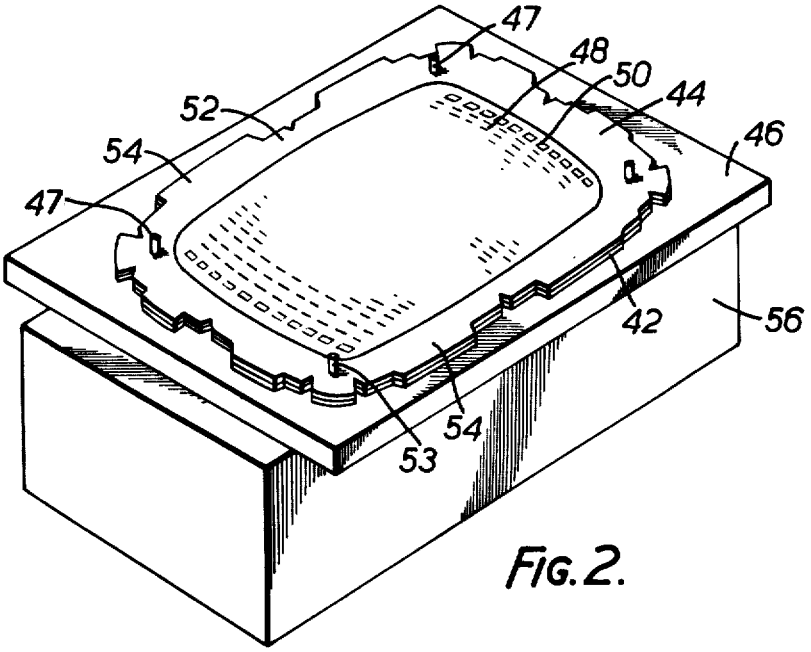
FIG. 2 is a perspective view showing one step of the fabrication method of the present invention.

Referring now to FIG. 2, there is shown in perspective view a step in the manufacturing process of the present invention. Two apertured flat masks 42 and 44 are placed on a surface plate 46 made of iron, which surface plate has a flat surface. Each of the apertured flat mask 42 and 44 includes an effective portion 48 having a plurality of slit apertures 50, a non-effective portion 52 surrounding the effective portion 48 and welding portions 54 provided at the periphery of the non-effective portion 52. Guide holes 53 for regulating the corresponding apertures 50 of each mask are provided at the four corners of the non-effective portion. Guide holes 53 are adapted to location regulating pins 47 provided with surface plate 46, the corresponding apertures of each mask being arranged with high precision. However, there are formed small gaps between the flat masks 42 and 44 resulting from the deformation or the warp of the flat masks formed during handling because of their very small thickness. Under such circumstances, if the flat masks 42 and 44 were welded together and pressed into the desired curvature shape, the sliding and the non-uniform stretching of the masks would occur to the gaps resulting in the shape of aperture being deformed and the corresponding apertures of each mask being offset.

Therefore in the present invention, a magnetic generating apparatus 56 is provided for generating electromagnetic force through the surface plate 46. When the magnetic generating apparatus operates, the stacked apertured flat masks 42 and 44 are firmly pressed together over their entire areas and the gaps between the masks are eliminated. When the flat masks are held tightly by the magnetic force, they are welded together at their respective welding portions 54 by seam welding or spot welding.

After welding the masks, the magnetic generating apparatus 56 is deactivated so as to remove the magnetic force and the welded flat masks 42 and 44 are removed from the surface plate 46. Then the welded flat masks 42 and 44 are simultaneously pressed into the desired predetermined curvature shape in a same manner of pressing a shadow mask of conventional cathode ray tube.

Figure 3:
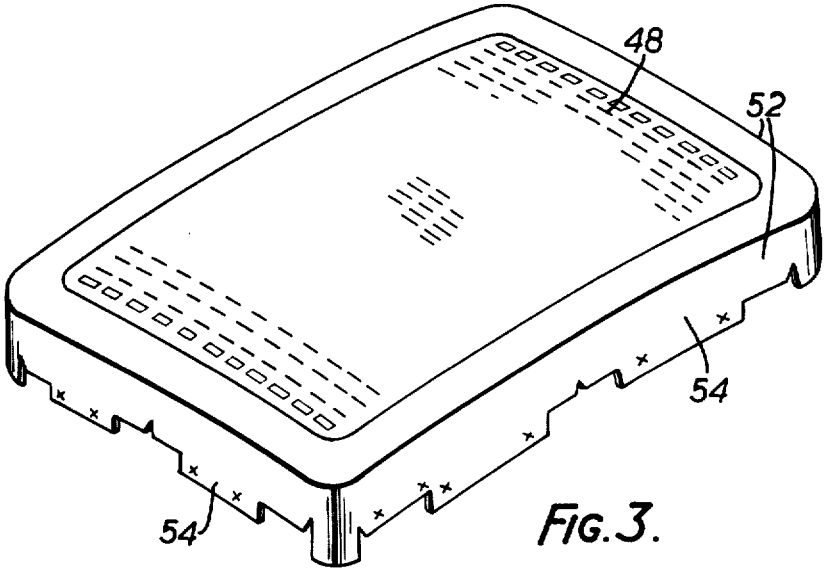
FIG. 3 is a perspective view of masks showing one step of the fabrication method of the present invention.

Referring now to FIG. 3, there is shown in perspective view pressed masks 42 and 44. X-marks denote the welded points. After the masks are pressed to the desired shape, the welded portions 54 are cut off from masks 42 and 44 with scissors or the laser beam and the masks are separated. The separated masks are held fixedly by a mask frame so as to be separated from each other with predetermined gap as shown in FIG. 1.

In the embodiment shown and discussed, a strong magnetic field is effective to hold the masks tightly to one another and to surface plate 46. For example, for two flat masks of about 180 mm×140 mm and 0.15 mm in thickness, more than about 500 gauss of the magnetic field at surface plate 46 is effective.

The two masks formed by the above-mentioned manner can be constructed into a mask structure without any distortion of apertures and any offset of the corresponding apertures of each mask.

According to the present invention, two apertured flat masks are stacked on the surface plate and are welded together and are pressed into predetermined curvature shape at the same time. So that it is easy to align the corresponding apertures of each mask. Particularly the welding step is performed during a time when a magnetic force is holding the flat masks in firm contact with one another so that the gaps between the flat masks caused by their natural deformed curvature are effectively eliminated. And the sliding and non-uniform stretching of the masks which would normally occur happended during the pressing step if there were gaps between the masks, are prevented. Masks for a color CRT having a plurality of masks whose apertures of each mask being arranged coaxially with high precision can be made easily by this method.

It should be undertsood that the present invention can be applied to the manufacture of more than two masks even though a two mask embodiment was described. Furthermore, it should be understood that it is useful to put the stacked flat masks into the magnetic field and then remove them after welding instead of actuating and deactuating the magnetic generating apparatus.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What is claimed is:

1. A method of making masks for a cathode ray tube (CRT) comprising the steps of:

stacking two (2) flat masks, each mask comprises an effective portion having a plurality of apertures, a non-effective portion surrounding said effective portion and welding portions located the periphery of said non-effective portions;

applying a magnetic force to said flat masks to hold them in contact with each other;

welding said flat masks together at their respective welding portions;

releasing said welded flat masks from said magnetic force;

simultaneously pressing said welded flat masks into the predetermined curvature; and cutting off said welding portions from the masks.

2. A method of making masks for a CRT according to claim 1, wherein said step of applying a magnetic force comprises the step of applying an electro-magnetic force.

3. A method of making masks for a CRT according to claim 1, wherein said welding step comprises the step of spot welding.

4. A method of making masks for a CRT according to claim 1, wherein said welding step comprises the step of seam welding.

5. A method of making masks for a CRT according to claim 1, wherein said stacking step comprises the step of stacking the apertured flat masks on a substantially flat surface plate.

6. A method of making masks for a CRT according to claim 5, wherein said step of stacking on a surface plate comprises the step of stacking on an iron surface plate.

7. A method of making masks for a CRT according to claim 5, wherein said step of applying a magnetic force comprises the step of applying a magnetic force from a generating apparatus positioned under said surface plate.

* * * * *